United States Patent [19]

Watanabe et al.

[11] Patent Number: 5,061,440

[45] Date of Patent: Oct. 29, 1991

[54] FERRITIC HEAT RESISTING STEEL HAVING SUPERIOR HIGH-TEMPERATURE STRENGTH

[75] Inventors: Rikizo Watanabe, Yasugi; Toshio Fujita, Tokyo, both of Japan

[73] Assignee: Hitachi Metals, Ltd., Tokyo, Japan

[21] Appl. No.: 546,860

[22] Filed: Jul. 2, 1990

Related U.S. Application Data

[63] Continuation of Ser. No. 482,752, Feb. 21, 1990.

[30] Foreign Application Priority Data

Feb. 23, 1989 [JP] Japan ..... 01-044348

[51] Int. Cl.[5] ..... C22C 38/52

[52] U.S. Cl. ..... 420/38; 420/69

[58] Field of Search ..... 420/38, 37, 69; 148/327

[56] References Cited

FOREIGN PATENT DOCUMENTS

| | | |
|---|---|---|
| 2032366 | 11/1970 | France . |
| 658115 | 10/1951 | United Kingdom . |
| 795471 | 5/1958 | United Kingdom . |
| 796733 | 6/1958 | United Kingdom . |

*Primary Examiner*—Deborah Yee

*Attorney, Agent, or Firm*—Antonelli, Terry, Stout & Kraus

[57] ABSTRACT

A ferritic heat resisting steel usable as the material of parts of steam and gas turbines of a power generating plant. Co content and Mo content are increased as compared with known alloy steels of the same kind. For instance, the alloy steel has a composition containing, by weight, 0.05 to 0.20% C, 0.05 to 1.5% Mn, 0.05 to 1.0% Ni, 9.0 to 13.0% Cr, 0.05 to less than 0.50% Mo, 2.0 to 3.5% W, 0.05 to 0.30% V, 0.01 to 0.20% Nb, 2.1 to 10.0% Co, 0.01 to 0.1% N, and the balance substantially Fe and incidental impurities, with Si as an impurity limited to be not more than 0.15%.

5 Claims, No Drawings

FERRITIC HEAT RESISTING STEEL HAVING SUPERIOR HIGH-TEMPERATURE STRENGTH

This is a continuation of application Ser. No. 482,752, filed Feb. 21, 1990.

BACKGROUND OF THE INVENTION

The present invention relates to a ferritic heat resisting steel having superior high-temperature strength and suitable for use as material of parts of power-generating steam and gas turbines, particularly, turbine blades, turbine disks and bolts used in such turbines.

In recent years, there is a trend for higher operation temperature and pressure of steam power-generating stations for the purpose of attaining higher efficiency. For instance, steam temperature in gas turbines, which is 566° C. at the highest in existing turbines, is planned to be elevated to 600° C. and finally to 650° C. A higher steam temperature essentially requires heat resisting materials which are superior in high-temperature strength to conventionally used ferritic heat resisting steels. Some of austenitic heat resisting alloy steel exhibit superior high-temperature strength. These heat-resisting alloy steels, however, cannot be put to practical use partly because of inferior thermal fatigue strength due to large thermal expansion coefficient and partly because of high price.

Under these circumstances, there have been proposed many ferritic heat resisting steels having improved high-temperature strength. Examples of such strength. Throughout the study, the present inventors have found that the high-temperature strength is further improved by multiplied effect of W and Co, when Co content is positively increased as compared with the alloys of the same type while adding Mo and W simultaneously with the W content increased as compared with the known alloys. The present invention is based upon this discovery.

According to one aspect of the present invention, there is provided a ferritic heat resisting steel having a composition containing, by weight, 0.05 to 0.20% C (carbon), 0.05 to 1.5% Mn, 0.05 to 1.0% Ni, 9.0 to 13.0% Cr, 0.05 to less than 0.50% Mo, 2.0 to 3.5% W, 0.05 to 0.30% V, 0.01 to 0.20% Nb, 2.1 to 10.0% Co, 0.01 to 0.1% N, and the balance substantially Fe and incidental impurities, with Si as an impurity limited to be not more than 0.15%. Part of Fe may be substituted by 0.001 to 0.030% of B.

According to another aspect of the present invention, there is provided a ferritic heat resisting steel having a composition containing, by weight, 0.09 to 0.13% C, 0.3 to 0.7% Mn, 0.3 to 0.7% Ni, 9.0 to 13.0% Cr, 0.1 to 0.2% Mo, 2.4 to 3.0% W, 0.15 to 0.25% V, 0.05 to 0.13% Nb, 2.1 to 4.0% Co, 0.02 to 0.04% N, and the balance substantially Fe and incidental impurities, with Si as an impurity limited to be not more than 0.15%. Part of Fe may be substituted by 0.001 to 0.030% of B.

According to still another aspect of the invention, there is provided a ferritic heat resisting 1 steel having a composition containing, by weight, 0.10 to 0.12% C, 0.35 to 0.65% Mn, 0.4 to 0.6% Ni, 10.8 to 11.2% Cr, 0.1 to 0.2% Mo, 2.5 to 2.7% W, 0.15 to 0.25% V, 0.05 to 0.11% Nb, 2.7 to 3.1% Co, 0.02 to 0.03% N, 0.01 to 5 0.02% B, and the balance substantially Fe and incidental impurities, with Si as an impurity limited to be not more than 0.10%.

DETAILED DESCRIPTION OF THE INVENTION

Features of the alloy of the present invention will be described in more detail through comparison with known alloys.

Inventions disclosed in above-mentioned Japanese Patent Unexamined Publication Nos. from 62-103345 to 61-69948, which one of the inventors of the present invention took part in, disclose 10 types of alloy steels. These 10 types of alloy steel do not contain Co at all or, even if not, have very small Co content which is not greater than 1%. Namely, it has been a common understanding that addition of a large amount of Co is inadequate particularly in W-containing steel which tends to exhibit reduced ductility because Co impairs Charpy impact value. A study conducted by the present inventors, however, proved that such undesirable effect is not found even when Co is added in excess of 2.1% but, rather, addition of Co in an amount not less than 2.1%, preferably not less than 2.7%, produces a remarkable effect in improving high-temperature strength. Thus, according to the invention, a further improvement in high-temperature strength is attained by adding not less than 2.1% of Co.

The alloy disclosed in Japanese Patent Unexamined Publication No. 57-207161 has Mo content of 0.5 to 2.0%, W content of 1.0 to 2.5% and Co content of 0.3 to 2.0%. Thus, Mo and W are regarded as being equally significant elements so that their contents are increased, whereas the Co content is reduced. In contrast, in the alloy steel of the present invention, the Mo content is reduced down below the range in the above-mentioned alloy steel, while a greater importance is given to W so that the W content is increased to a level above the range in the above-mentioned alloy steel, so that the high-temperature strength is further improved by multiplied effect produced by the W and Co the contents of which are increased.

Japanese Patent Examined Publication No. 57-25629 discloses a material which is intended for use as the material of wall of a combination chamber of an internal combustion engine and, hence, is a case steel designed with importance given to thermal fatigue strength. In this material, Si is added for the purpose of deoxidation, as well as improvement in fluidity and anti-oxidation at high temperature during casting. To these ends, Si is added in an amount ranging between 0.2 and 3.0%. This material, therefore, is entirely different from the alloy steel of the present invention both in composition and use. Namely, in the alloy steel of the present invention, Si is a detrimental element which impairs ductility and, hence, Si content is limited to be below 0.15% unlike the material disclosed in Japanese Patent Examined Publication No. 57-25629. Japanese Patent Examined Publication No. 57-25629 also discloses a material in which one of Mo, W, Nb, V and Ti is added because these elements are considered as being equivalent in effect. In contrast, in the alloy steel of the present invention, it is necessary that Mo, W, Nb and V are contained simultaneously because these elements are expected to play independent functions. Thus, this material disclosed in Japanese Patent Examined Publication No. 57-25629 is based on a technical idea entirely different from that of the invention of this application. The difference in the alloy composition causes fundamentally different characteristics. For instance, while the material disclosed in Japanese Patent Examined Publication No. 57-25629 shows 700° C.-100 hour creep rupture strength which is 12.5 kgf/mm$^2$ at the greatest, whereas the alloy steel of the present invention shows 700° C.-100 hour creep rupture strength which is not smaller than 15 kgf/mm$^2$, thus proving a remarkable improvement in the strength.

A description will be given hereinafter of reasons of limiting the contents of the respective elements in the alloy steel of the present invention.

C (carbon) is an element which is essential for ensuring sufficient hardenability and for high-temperature strength through precipitation of $M_{23}C_6$ type carbide in the course of tempering. In order to obtain an appreciable effect, the C content should be 0.05% at the smallest. C content exceeding 0.20%, however, causes an excessive precipitation of $M_{23}C_6$ type carbide, with the result that the strength of the matrix is lowered to impair the high-temperature strength in long-time region. The C content, therefore, is determined to be 0.05 to 0.20%, preferably 0.09 to 0.13% and more preferably 0.10 to 0.12%.

Mn is an element which suppresses generation of δ ferrite so as to promote precipitation of $M_{23}C_6$ type carbide. To obtain an appreciable effect, the Mn content should be 0.05%. at the smallest. On the other hand, Mn impairs anti-oxidation resistance when its content exceeds 1.5%. The Mn content therefore is determined to range between 0.05 and 1.5%, preferably 0.3 to 0.7% and more preferably 0.35 to 0.65%.

Ni is an element which suppresses generation of δ ferrite so as to impart toughness. This effect is appreciable when Ni content is not less than 0.05%. Addition of Ni in excess of 1.0%, however, causes a reduction in creep rupture strength. The Ni content, therefore, is determined to be 0.05 to 1.0%, preferably 0.3 to 0.7% and more preferably 0.4 to 0.6%.

Cr is an element which is essential for imparting oxidation resistance and for improving high-temperature strength through precipitation of $M_{23}C_6$ type carbide. In order to attain an appreciable effect, it is essential that this element is contained in an amount of 9% at the smallest. On the other hand, addition of Cr in excess of 13% allows generation of δ ferrite resulting in reduced high-temperature strength and toughness. The Cr content, therefore, is determined to be 9.0 to 13.0%, preferably 10.8 to 11.2%.

Mo is an element which promotes fine precipitation of $M_{23}C_6$ type carbide so as to suppress aggregation. This material, therefore, is effective in maintaining high-temperature strength for long time. In order to obtain an appreciable effect, however, the Mo content should be 0.05% at the smallest. Conversely, Mo content exceeding 0.50% promotes generation of δ ferrite. The Mo content, therefore, is determined to be not less than 0.50% and less than 0.50%, preferably 0.1~0.2%.

W produces a greater effect in suppressing aggregation coarsening of $M_{23}C_6$ type carbide than Mo. In addition, this element produces a solid-solution strengthening effect on the matrix. To this end, W content should be 2.0% at the smallest. However, W content exceeding 3.5% tends to allow an easy generation of Laves phase, resulting in a reducing tendency of high-temperature strength. The W content, therefore, is determined to be 2.0 to 3.5%, preferably 2.4 to 3.0% and more preferably 2.5 to 2.7%.

V is an element which is effective in enhancing high-temperature strength by allowing precipitation of carbonitrides of V. In order to obtain an appreciable effect, the V content should be 0.05% at the smallest. However, V content exceeding 0.3% causes an excessive fixing of carbon so as to reduce the amount of precipitation of $M_{23}C_6$ type carbide resulting in a reduced high-temperature strength. The V content, therefore, is determined to be 0.05 to 0.3% preferably 0.15 to 0.25%.

Nb is an element which contributes to refining of crystal grains through formation of NbC. Part of Nb dissolved into matrix in the course of hardening and allows precipitation of NbC from matrix in the course of tempering so as to enhance high-temperature strength. In order to attain an appreciable effect, Nb content should be 0.01% at the smallest. Nb, when added in excess of 0.20%, excessively fixes carbon as is the case of V, with the result that the precipitation of $M_{23}C_6$ type carbide is reduced to cause a reduction in the high-temperature strength. The Nb content, therefore, is determined to be 0.01 to 0.20%, preferably 0.05 to 0.13% and more preferably 0.05 to 0.11%.

Co is an element which distinguishes the steel of the present invention from known steels and, hence, significant in the invention. Addition of Co in the alloy steel of the invention offers a remarkable improvement in high-temperature strength. This effect is considered to be attributable to an inter-action with W and is peculiar to the alloy steel of the present invention which contains 2% or more of W. In order to distinctively realize this advantageous effect, the Co content in this invention is determined not to be less than 2.1%. Addition of excess amount of Co impairs ductility and raises the production cost. The Co content, therefore, is determined not to exceed 10%. Preferably, the Co content is determined to be 2.1 to 4.0%, more preferably 2.7 to 3.1%.

N is an element which enhances high-temperature strength partly because of precipitation of nitrides of V and partly because of IS effect (interaction between invasion-type solid solution element and substitutive type solid solution element) produced in cooperation with Mo and W. In order to obtain an appreciable effect, N content should be 0.01% at the smallest. On the other hand, N content exceeding 0.1% causes a reduction in the ductility, so that N content is determined to be 0.01 to 0.1%, preferably 0.02 to 0.04% and more preferably 0.02 to 0.03%.

Si is a detrimental element which promotes generation of Laves phase and causes grain boundary segregation, resulting in reduced ductility. This element should be limited to be not more than 0.15%, preferably not more than 0.10%.

B is an element which produces a grain boundary strengthening effect and an effect for preventing aggregation and coarsening of $M_{23}C_6$ type carbide by dissolving into $M_{23}C_6$, thus contributing to improvement in high-temperature strength. In order to obtain an appreciable effect, B should be added in an amount of 0.001% at the smallest. Conversely, addition of B in excess of 0.030% impairs weldability and forging workability. The B content, therefore, is determined to be 0.001 and 0.030%, preferably 0.01 to 0.02%.

Example 1

Alloys of compositions shown in Table 1 were cast into ingots of 10 Kg weight by vacuum induction melting and the ingots were forged into bars of 30 mm square cross-section. The bars were then quenched from 1100° C. for 1 hour, followed by a 750° C. 1 hour tempering, and the thus treated bars were subjected to a 700° C.–15 kgf/mm$^2$ creep rupture test. The results of the test are shown also in Table 1.

From Table 1, it will be seen that the sample Nos. 1 to 12 of the alloy steel in accordance with the present invention exhibit much longer creep rupture life than sample Nos. 21 and 22 both of which are alloy steels equivalent to those disclosed in Japanese Patent Unexamined Publication No. 62-103345. The comparative alloy sample Nos. 13, 14, 18 and 19 have compositions which are the same as those of the invention except that Co is omitted. Sample No. 20 has a composition in which Co content is reduced as compared with the alloy steels of the present invention. Sample Nos. 15 has a composition which is devoid of Co and which has high Ni content, while Sample No. 16 has a composition which has a small n content and which is devoid of B and Co. Sample No. 17 has a composition which does not contain Co and which has a small N content. Among these comparison alloy samples, sample No. 13 exhibits a creep rupture strength that conventional alloy steels. The following comparison, therefore, is discussed using sample No. 13 as the reference.

TABLE 1

| No. | Chemical composition (wt %) C | Si | Mn | Ni | Cr | Mo | W | V | Nb | Co | N | B | Fe | Creep rupture strength 700° C.-15 kgf/mm$^2$ | 650° C. - $10^4$ hr creep rupture strength | Remarks |
|---|---|---|---|---|---|---|---|---|---|---|---|---|---|---|---|---|
| 1 | 0.11 | 0.01 | 0.50 | 0.54 | 10.72 | 0.15 | 2.61 | 0.20 | 0.09 | 2.15 | 0.025 | 0.014 | Bal | 276 hours | — | Alloy of the |
| 2 | 0.11 | 0.01 | 0.50 | 0.50 | 10.98 | 0.15 | 2.59 | 0.21 | 0.09 | 2.87 | 0.025 | 0.014 | " | 314 hours | 20 kgf/mm$^2$ | Present |
| 3 | 0.11 | 0.01 | 0.51 | 0.53 | 11.00 | 0.16 | 2.55 | 0.22 | 0.08 | 5.79 | 0.027 | 0.015 | " | 503 hours | — | Invention |
| 4 | 0.11 | 0.01 | 0.48 | 0.49 | 11.03 | 0.18 | 2.60 | 0.19 | 0.08 | 9.43 | 0.030 | 0.016 | " | 487 hours | — | |
| 5 | 0.06 | 0.01 | 0.49 | 0.50 | 11.15 | 0.17 | 2.70 | 0.20 | 0.09 | 5.14 | 0.089 | 0.015 | " | 260 hours | — | |
| 6 | 0.18 | 0.01 | 0.45 | 0.51 | 10.85 | 0.19 | 2.72 | 0.19 | 0.18 | 3.01 | 0.012 | 0.013 | " | 322 hours | — | |
| 7 | 0.12 | 0.01 | 1.30 | 0.11 | 11.24 | 0.20 | 2.65 | 0.18 | 0.11 | 2.98 | 0.051 | 0.003 | " | 391 hours | — | |
| 8 | 0.13 | 0.01 | 0.15 | 0.89 | 11.35 | 0.09 | 2.91 | 0.27 | 0.10 | 4.50 | 0.045 | 0.027 | " | 455 hours | — | |
| 9 | 0.06 | 0.01 | 0.24 | 0.28 | 9.33 | 0.44 | 2.05 | 0.09 | 0.02 | 4.87 | 0.090 | 0.010 | " | 205 hours | — | |
| 10 | 0.09 | 0.01 | 0.64 | 0.09 | 10.54 | 0.32 | 3.33 | 0.14 | 0.15 | 2.77 | 0.028 | 0.020 | " | 224 hours | — | |
| 11 | 0.15 | 0.01 | 0.09 | 0.33 | 12.63 | 0.27 | 2.46 | 0.16 | 0.08 | 3.01 | 0.035 | 0.022 | " | 286 hours | — | |
| 12 | 0.12 | 0.01 | 0.37 | 0.71 | 10.22 | 0.14 | 2.41 | 0.23 | 0.06 | 3.45 | 0.034 | 0.018 | " | 253 hours | — | |
| 13 | 0.11 | 0.01 | 0.52 | 0.90 | 10.87 | 0.15 | 2.60 | 0.21 | 0.11 | — | 0.026 | 0.014 | Bal | 109 hours | 17 kgf/mm$^2$ | Comparative |
| 14 | 0.11 | 0.01 | 0.51 | 0.50 | 10.78 | 0.15 | 2.58 | 0.21 | 0.14 | — | 0.026 | 0.013 | " | 77 hours | — | Alloy |
| 15 | 0.10 | 0.01 | 0.52 | 1.46 | 11.01 | 0.15 | 2.60 | 0.20 | 0.10 | — | 0.023 | 0.014 | " | 88 hours | — | |
| 16 | 0.14 | 0.01 | 0.56 | 0.57 | 11.00 | 0.14 | 2.35 | 0.21 | 0.08 | — | 0.002 | — | " | 1 hours | — | |
| 17 | 0.15 | 0.01 | 0.56 | 0.56 | 10.79 | 0.14 | 2.36 | 0.18 | 0.08 | — | 0.004 | 0.013 | " | 3 hours | — | |
| 18 | 0.11 | 0.01 | 0.54 | 0.60 | 10.62 | 0.13 | 2.35 | 0.19 | 0.08 | — | 0.024 | 0.013 | " | 35 hours | — | |
| 19 | 0.10 | 0.01 | 0.57 | 0.57 | 11.02 | 0.13 | 2.35 | 0.20 | 0.08 | — | 0.050 | 0.014 | " | 94 hours | — | |
| 20 | 0.11 | 0.01 | 0.51 | 0.96 | 11.09 | 0.15 | 2.57 | 0.21 | 0.09 | 1.59 | 0.039 | 0.014 | " | 108 hours | — | |
| 21 | 0.10 | 0.01 | 0.58 | 0.57 | 11.07 | 0.12 | 2.35 | 0.20 | 0.09 | — | 0.052 | — | " | 44 hours | — | Conventional |
| 22 | 0.12 | 0.01 | 0.55 | 0.55 | 10.92 | 0.14 | 2.37 | 0.19 | 0.08 | — | 0.021 | — | " | 39 hours | — | Alloy |

EXAMPLE 2

The alloy steel sample No. 2 as a representative of the alloy steel of the present invention and comparison alloy steel sample Nos. 13 which is the strongest one of the comparison alloy steels were subjected to creep rupture tests which were conducted under various stress conditions at different temperatures of 600, 650 and 700° C., and 650° C. $10^4$-hour creep rupture strength values of these alloy steels were predicted from the results of the test. These values also are shown in Table 1. It will be seen that the alloy steel sample No. 2 of the present invention exhibits $10^4$-hour creep rupture strength which is about 20% greater than that of the comparison alloy steel sample No. 13, thus providing much superior creep rupture strength as compared with conventional alloy steels. In fact, the alloy steel of the invention well exhibits a 650° C. $10^4$-hour creep rupture strength of 20 kpf/mm$^2$ which is about 50% greater than 14.0 kgf/mm$^2$ which is the maximum value exhibited by the alloy steel disclosed in Japanese Patent Unexamined Publication No. 62-103345.

TABLE 2

| No. | Test temp. (°C.) | Yield strength (kgf/mm$^2$) | Tensile strength (kgf/mm$^2$) | Elongation (%) | Reduction of area (%) | Charpy impact strength (kgf · m/cm$^2$) | Hardness (HRC) |
|---|---|---|---|---|---|---|---|
| 2 | RT* | 79.4 | 93.1 | 17.5 | 68.0 | 4.5 | 29.6 |
| | 500 | 58.2 | 65.5 | 16.5 | 73.3 | — | — |
| | 600 | 44.3 | 51.2 | 21.3 | 80.6 | — | — |
| | 650 | 33.4 | 41.9 | 26.7 | 84.1 | — | — |
| | 700 | 26.0 | 32.5 | 25.6 | 86.0 | — | — |
| 13 | RT* | 81.6 | 95.0 | 18.2 | 68.8 | 5.5 | 28.8 |
| | 500 | 59.8 | 67.7 | 15.2 | 73.4 | — | — |
| | 600 | 45.9 | 53.6 | 19.8 | 82.0 | — | — |
| | 650 | 35.7 | 44.2 | 22.9 | 82.6 | — | — |
| | 700 | 27.2 | 35.0 | 25.1 | 86.1 | — | — |

*RT: Room temperature

EXAMPLE 3

The alloy steel sample Nos. 2 and 13 mentioned in Example 2 were subjected to a tensile test at temperature varied between the room temperature (20° C.) and 2 mm V-notch Charpy impact test, the results being shown in Table 2. It will be seen that the alloy steel sample No. 2 of the invention exhibits substantially no degradation in ductility and toughness as compared with the comparison alloy steel No. 13 which does not contain Co.

EXAMPLE 4

Three alloys of the invention having compositions shown in Table 3 were formed into ingots of 10 kg weight under a vacuum after melting by vacuum induction melting process. These ingots were then forged into bars of 30 mm square cross-section. The bars were then subjected to 1100° C. 1-hour hardening, followed by a 750° C. 2-hour tempering, and the thus, treated bars were subjected to a creep rupture test conducted at 700° C. so as to determine a 700° C. 1000-hour creep rupture strength. The results are also shown in Table 3.

From Table 3, it will be understood that all the alloy steels in accordance with the present invention has 700° C. 1000-hour creep rupture strength which is not smaller than 10 kgf/mm$^2$. The alloy steel sample No. 31, which has a large N content, exhibits lower 700° C. 1000-hour creep rupture strength then alloy steel sample Nos. 2 and 32 which have N content of 0.025%.

As will be apparent from the foregoing description, the alloy steel of the present invention, when used as the material of turbine blade, turbine disks and bolts of a turbine in a power generating plant, enables the steam temperature to be raised to 650° C., thus remarkably contributing to improvement in the efficiency of such a power generating plant.

TABLE 3

| No. | Chemical composition (wt %) | | | | | | | | | | | | 700° C.-1000 hr rupture strength (kgf/mm$^2$) |
|---|---|---|---|---|---|---|---|---|---|---|---|---|---|
| | C | Si | Mn | Ni | Cr | Mo | W | V | Nb | Co | N | B | |
| 2 | 0.11 | 0.01 | 0.50 | 0.50 | 10.98 | 0.15 | 2.59 | 0.21 | 0.09 | 2.87 | 0.025 | 0.014 | 12.0 |
| 31 | 0.12 | 0.02 | 0.52 | 0.49 | 11.05 | 0.15 | 2.64 | 0.20 | 0.07 | 2.94 | 0.047 | 0.014 | 10.3 |
| 32 | 0.11 | 0.01 | 0.54 | 0.48 | 10.98 | 0.15 | 2.62 | 0.20 | 0.08 | 2.93 | 0.025 | 0.013 | 11.7 |

What is claimed is:

1. A ferritic heat resisting steel having a composition containing, by weight, 0.05 to 0.20% C, 0.05 to 1.5% Mn, 0.05 to 1.0% Ni, 9.0 to 13.0% Cr, 0.05 to less than 0.50% Mo, 2.0 to 3.5% W, 0.05 to 0.30% V, 0.01 to 0.20% Nb, 2.1 to 10.0% Co., 0.01 to 0.1% N, and the balance substantially Fe and incidental impurities, with Si as an impurity limited to be not more than 0.10%.

2. A ferritic heat resisting steel having a composition containing, by weight, 0.05 to 0.20% C, 0.05 to 1.5% Mn, 0.05 to 1.0% Ni, 9.0 to 13.0% Cr, 0.05 to less than 0.50% Mo, 2.0 to 3.5% W, 0.05 to 0.30% V, 0.01 to 0.20% Nb, 2.1 to 10.0% Co., 0.01 to 0.1% N, 0.001 to 0.30% B, and the balance substantially Fe and incidental impurities, with Si as an impurity limited to be not more than 0.10%.

3. A ferritic heat resisting steel having a composition containing, by weight, 0.09 to 0.13% C, 0.3 to 0.7% Mn, 0.3 to 0.7% Ni, 9.0 to 13.0% Cr, 0.1 to 0.2% Mo, 2.4 to 3.0% W, 0.15 to 0.25% V, 0.05 to 0.13% Nb, 2.1 to 4.0% Co, 0.02 to 0.04% N, and the balance substantially Fe and incidental impurities, with Si as an impurity limited to be not more than 0.10%.

4. A ferritic heat resisting steel having a composition containing, by weight, 0.09 to 0.13% C, 0.3 to 0.7% Mn, 0.3 to 0.7% Ni, 9.0 to 13.0% Cr, 0.1 to 0.2% Mo, 2.4 to 3.0% W, 0.15 to 0.25% V, 0.05 to 0.13% Nb, 2.1 to 4.0% Co, 0.02 to 0.04% N, 0.001 to 0.030% B, and the balance substantially Fe and incidental impurities, with Si as an impurity limited to be not more than 0.10%.

5. A ferritic heat resisting steel having a composition containing, by weight, 0.10 to 0.12% C, 0.35 to 0.65% Mn, 0.4 to 0.6% Ni, 10.8 to 11.2% Cr, 0.1 to 0.2% Mo, 2.5 to 2.7% w, 0.15 to 0.25% V, 0.05 to 0.11% Nb, 2.7 to 3.2% Co, 0.02 to 0.03% N, 0.01 to 0.02% B, and the balance substantially Fe and incidental impurities, with Si as an impurity limited to be not more than 0.10%.

* * * * *